US007327966B2

(12) United States Patent
Watanabe

(10) Patent No.: US 7,327,966 B2
(45) Date of Patent: Feb. 5, 2008

(54) IMAGE FORMING APPARATUS

(75) Inventor: Takeshi Watanabe, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 149 days.

(21) Appl. No.: 11/361,003

(22) Filed: Feb. 24, 2006

(65) Prior Publication Data

US 2006/0204263 A1 Sep. 14, 2006

(30) Foreign Application Priority Data

Feb. 28, 2005 (JP) ..... 2005-054416

(51) Int. Cl.
*G03G 15/00* (2006.01)
*G03G 15/16* (2006.01)

(52) U.S. Cl. ..... 399/66; 399/43; 399/75; 399/101

(58) Field of Classification Search ..... 399/66, 399/43, 75, 76, 101
See application file for complete search history.

(56) References Cited

U.S. PATENT DOCUMENTS

2005/0141908 A1* 6/2005 Yamaguchi ..... 399/50

FOREIGN PATENT DOCUMENTS

JP 2003-29552 1/2003

* cited by examiner

*Primary Examiner*—Sophia S. Chen
(74) *Attorney, Agent, or Firm*—Smith, Gambrell & Russell, LLP

(57) ABSTRACT

A copying machine of the present invention includes a photosensitive drum, a transfer belt which is extended between a plurality of rollers and has a contact section in contact with the photosensitive drum, and a transfer bias supply which applies an electrical charge for transfer to the contact section. At the time of the start of an image forming operation, first, (a) the transfer bias supply is operated, and (b) the rollers are rotated, and then (c) the photosensitive drum is started rotation. By turning on the transfer bias supply prior to the operations of the photosensitive drum and the transfer belt, the photosensitive drum and the transfer belt are attracted to each other at the contact section, thereby preventing the photosensitive drum from rubbing against a foreign matter at the contact section.

3 Claims, 2 Drawing Sheets

IMAGE FORMING APPARATUS

BACKGROUND OF THE INVENTION

1. Field of the Invention

The present invention relates to an image forming apparatus having an image carrier such as a photosensitive drum.

2. Description of Related Art

In an image forming apparatus such as a copying machines or a printer, an electrostatic latent image is formed on a photosensitive drum, developed with a toner, and then the developed toner image is transferred on a sheet. In such image forming apparatus, the sheet in the apparatus may be conveyed using an endless belt (refer to, for example, Japanese Unexamined Patent Publication No. 2003-29552).

The belt is extended by a driving roller and a driven roller and rotationally moved by the driving of the driving roller. The belt is held between the photosensitive drum and a transfer roller and a position in which the belt is held is defined as a transfer position. At the time of image formation, the sheet is conveyed by the belt to the transfer position and the toner image on the photosensitive drum is transferred due to transfer bias of the transfer roller.

The photosensitive drum is in contact with the belt at the transfer position and a foreign matter (hard material such as sand) may enter at the transfer position. At this time, when there is a difference in speed between the photosensitive drum and the belt at the transfer position, the foreign matter rubs against the photosensitive drum, causing a scratch on the surface of the photosensitive drum. Especially at the time of start of an image forming operation, since the photosensitive drum and the belt are each transited from the stop state to the driving state, the speed difference between the photosensitive drum and the belt is easy to occur, thereby causing a scratch on the photosensitive drum. If the photosensitive drum is scratched, the scratched region cannot be charged, resulting in deterioration in image quality.

The belt is hung about the driving roller and the driven roller with a slight slack in the stop state. As a result, it requires a time period from when the driving roller starts driving until the belt is applied a sufficient tension to move at a constant speed. In other words, the time during which the belt reaches the constant speed for the image forming operation is needed.

SUMMARY OF THE INVENTION

Against this background, an object of the present invention is to provide an image forming device which prevents a photosensitive drum as an image carrier from being scratched.

Another object of the present invention is to provide an image forming device which enables reduction in rising time of an image forming operation.

One aspect of the present invention is an image forming device having a driving start control means which, at the time of the start of an image forming operation, starts operations of a transfer bias applying means, a roller and an image carrier at predetermined minute intervals in the following order: (a) operates the transfer bias applying means, (b) rotates the roller, and then (c) start rotating the image carrier.

With this configuration, by operating the transfer bias applying means prior to the operations of the image carrier and the belt, an electrical charge for transfer is applied on a contact section so as to attract the image carrier and the transfer belt to each other. Thus, at the time of the start of the image forming operation when the image carrier and the transfer belt easily rub against each other, these components move together, thereby preventing the rubbing. As a result, even when a foreign matter such as sand enters the contact section, it can be prevented that the image carrier from rubbing against the foreign matter and being scratched, thereby preventing deterioration in image quality caused by generating an unnecessary toner image.

Furthermore, by rotating the rollers ahead of the image carrier in the state where the image carrier and the transfer belt are attracted to each other at the contact section, the time from when a sufficient tension is applied on the transfer belt by the roller until the transfer belt is stably driven can be shortened. As a result, the time (first output time) from the start of the image forming operation to the image formation on a first sheet can be shortened, thereby further decreasing the rising time of the image forming operation.

Furthermore, in consideration of the time (time lag) from the start of the rotation of the roller to the stable driving of the transfer belt, the rotation of the image carrier is started after the expiration of a minute time from the start of the rotation of the roller. Thus, the speed of the transfer belt and the image carrier can be synchronized, so that it can be prevented more securely that the image carrier and the foreign matter from rubbing against each other.

Another aspect of the present invention is an image forming device further including a stop control means which stops the operation of the transfer bias applying means after stopping the rotational movement of the transfer belt and the rotation of the image carrier.

With this configuration, at the time of the termination of the image forming operation, the image carrier and the transfer belt are attracted to each other at the contact section due to the application of transfer bias until the transfer belt and the image carrier are completely stopped. Thus, at the time of the termination of the image forming operation when the image carrier and the transfer belt easily rub against each other, both components move together, thereby preventing the rubbing. As a result, it can be prevented that the image carrier from rubbing against the foreign matter at the contact section and being scratched, thereby preventing deterioration in image quality caused by generating an unnecessary toner image.

The image carrier of the present invention is preferably formed using amorphous silicone.

Even when the image carrier is formed using hard amorphous silicon, since the image carrier can be prevented from rubbing against the foreign mater at the contact section, the image carrier can be satisfactorily prevented from being scratched.

DETAILED DESCRIPTION OF PREFERRED EMBODIMENTS

An embodiment of the present invention will be specifically described with reference to figures.

Figure 1:
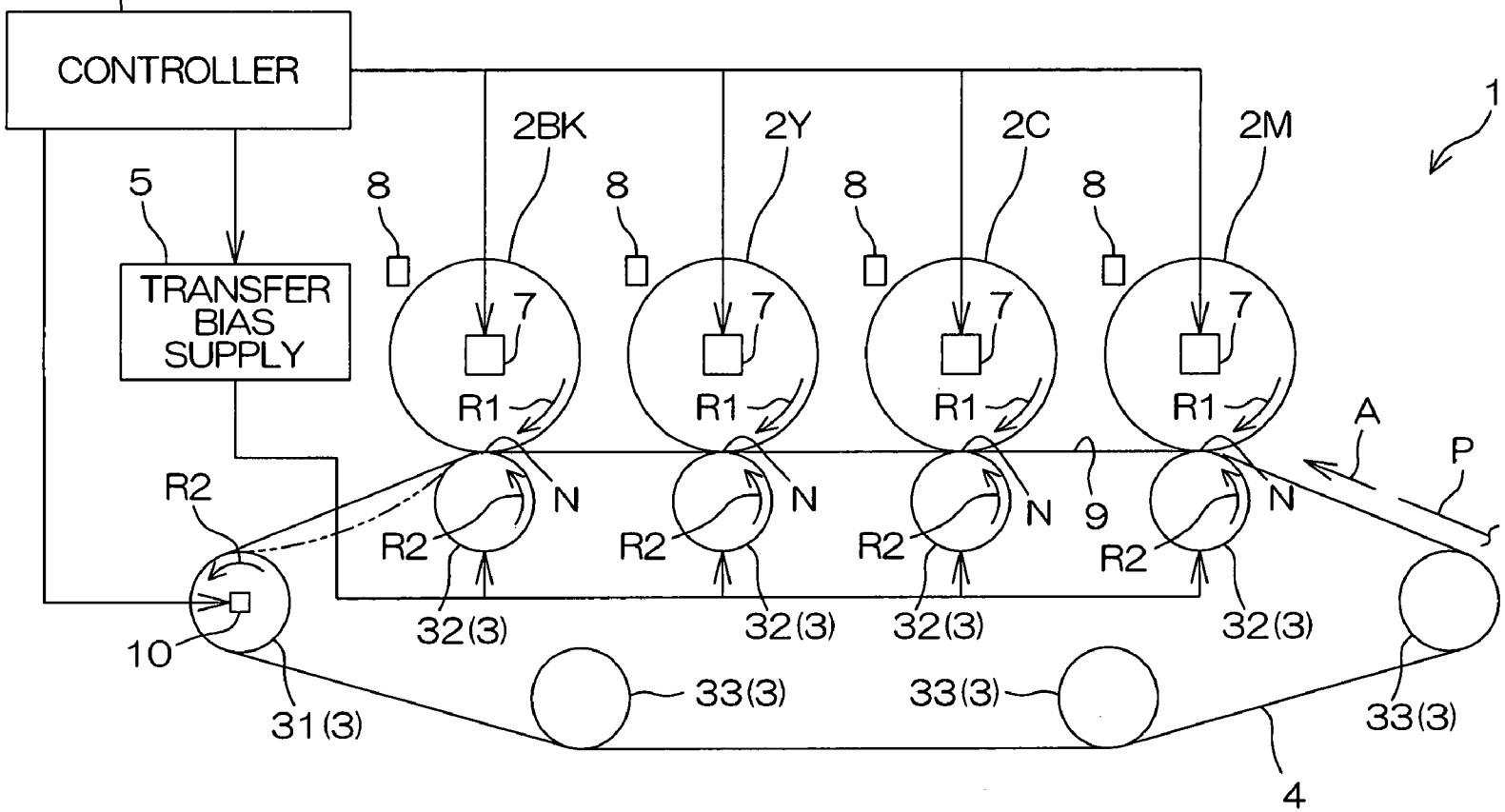
FIG. 1 is a schematic side view showing a schematic configuration of a copying machine as an image forming device in accordance with an embodiment of the present invention.

FIG. 1 a schematic view showing a schematic configuration of a copying machine as an image forming device in accordance with the embodiment of the present invention. With reference to FIG. 1, a copying machine 1 is a so-called tandem electrophotographic digital color copying machine capable of forming a full-color image by sequentially laying a toner of each color of magenta (M) cyan (C), yellow (Y) and black (BK) on a sheet on the basis of color image data.

The copying machine 1 includes four substantially cylindrical photosensitive drums 2M, 2C, 2Y and 2BK as image carriers (drum-shaped image carriers) corresponding to the respective colors, a plurality of rollers 3, an endless transfer belt 4 stretched between the rollers 3, a transfer bias supply (transfer bias applying means) 5 and a controller (driving start control means, stop control means) 6.

The photosensitive drums 2M, 2C, 2Y and 2BK each have a surface layer containing amorphous silicon (A-Si) and are arranged in the horizontal direction along the transfer belt 4. These photosensitive drums 2M, 2C, 2Y and 2BK are each driven by corresponding drum motors 7 so as to be rotated in a predetermined rotating direction R1 (clockwise in FIG. 1). Each of the drum motors 7 is formed of a DC (direct current) motor, for example. The drum motor 7 may be a stepping motor.

In forming an image, a toner image of magenta is formed on the photosensitive drum 2M on the basis of image data. Similarly, a toner image of cyan is formed on the photosensitive drum 2C on the basis of the image data. A toner image of yellow is formed on the photosensitive drum 2Y on the basis of the image data. A toner image of black is formed on the photosensitive drum 2BK on the basis of the image data.

Cleaning devices 8 are formed in the periphery of the photosensitive drums 2M, 2C, and 2Y and 2BK, respectively. The cleaning devices 8 are each arranged downstream of a contact section N which will be described later in the rotating direction R1 of the corresponding photosensitive drums 2M, 2C, 2Y and 2BK to collect remaining toner which is not transferred on a sheet P.

The transfer belt 4 is a belt made of a resin having elasticity and electrostatic property and is located below the photosensitive drums 2M, 2C, 2Y and 2BK. PVDF (PolyVinyliDeneFluoride), ETFE (Ethylene Tetrafluoro Ethylene) and PI (Polyimide) can be adopted as the above-mentioned resin. A thickness of the transfer belt 4 is 0.1 mm, for example and a volume resistance of the transfer belt 4 is $1.0\times10^{12}$ to $1.0\times10^{13}$ Ωcm, for example.

A part of an upper portion of the transfer belt 4 is straightly extended in the horizontal direction to form a stretch section 9. A surface (top face) of the stretch section 9 contacts with the photosensitive drums 2M, 2C, 2Y and 2BK at contact sections N (nip), respectively.

The rollers 3 are arranged on the inner side of the transfer belt 4 in the radial direction. At least two (eight in this embodiment) rollers 3 are provided including a driving roller 31.

The driving roller 31 serves to rotationally move the transfer belt 4 in a rotating direction (counterclockwise direction) R2. The driving roller 31 is arranged downstream in a conveying direction A of the sheet P in comparison to the photosensitive drum 2BK located at the most downstream section in the conveying direction A. This driving roller 31 is rotated by the driving of a roller motor 10. The roller motor 10 is formed of a stepping motor, for example.

The driving roller 31 is formed to have a diameter of 15.2 mm, for example. Specifically, the driving roller 31 is formed by externally fitting a cylindrical rubber of 0.5 mm in thickness over a metal shaft of 14.2 mm in diameter. EPDM (Ethylene-Propylene-Diene Methylene linkage) can be adopted as the rubber.

The rollers 3 further include transfer rollers 32 and idle rollers 33 as driven rollers rotated by the rotational movement of the transfer belt 4.

The transfer rollers 32 serve to transfer toner images formed on the photosensitive drums 2M, 2C, 2Y and 2BK on the sheet P. In this embodiment, four transfer rollers 32 are provided at positions opposed to the contact sections N of the photosensitive drums 2M, 2C, 2Y and 2BK, respectively.

The transfer rollers 32 are each connected to a transfer bias supply 5 to apply an electrical charge for transfer to the contact sections N.

Each of the transfer rollers 32 is formed so as to have a diameter of 15 mm, for example. Specifically, the transfer roller 32 is formed by externally fitting a cylindrical foam of 3.5 mm in thickness over a metal shaft of 8 mm in diameter. EPDM (Ethylene-Propylene-Diene Methylene linkage) can be adopted as the foam. A resistance of each transfer roller 32 is $1.0\times10^{6}$ to $1.0\times10^{7}$ ohms, for example.

In this embodiment, three idle rollers 33 are provided for example. The rollers are arranged both upstream in the conveying direction A of the sheet P in comparison to the photosensitive drum 2M located at the most upstream section in the conveying direction A, and downstream in the rotating direction of the transfer belt 4 in comparison to the driving roller 31, respectively.

The transfer bias supply 5 serves to apply an electrical charge for transfer to the contact sections N through the transfer rollers 32. The transfer bias supply 5 feeds the electrical charge (according to constant current control) so that a current becomes a predetermined value, for example, 15 μA when the toner images formed on the photosensitive drums 2M, 2C, 2Y and 2BK are transferred to the sheet P, and feeds the electrical charge (according to constant voltage control) so that a voltage becomes a predetermined value, for example, +1.3 kV both at the time of the start and termination of the image forming operation.

The controller 6 includes a CPU, a RAM and a ROM and can control the operation of the transfer bias supply 5, the rotational movement of the transfer belt 4 and the rotation of the photosensitive drums 2M, 2C, 2Y and 2BK, respectively. Specifically, the controller 6 is connected to each of the drum motors 7 of the photosensitive drums 2M, 2C, 2Y and 2BK, the roller motor 10 and the transfer bias supply 5, respectively. Thus, the controller 6 can perform the driving and stop of each drum motor 7 and the roller motor 10, as well as the operation (turning on and off) of the transfer bias supply 5.

The image forming operation of the copying machine 1 is carried out as follows. That is, the sheet P is moved on the transfer belt 4 in the conveying direction A while the photosensitive drums 2M, 2C, 2Y and 2BK are rotated and the transfer belt 4 is rotationally moved. The toner image of magenta formed on the photosensitive drum 2M is transferred to the sheet P which reaches the contact section N of the photosensitive drum 2M by the transfer roller 32. Similarly, the toner images of cyan, yellow and black are sequentially transferred to the sheet P. The toner images are fixed on the sheet P sent from the transfer belt 4 through the contact section N of the photosensitive drum 2BK by using a fixing device (not shown) and then, the sheet P is discharged.

A feature of this embodiment is that, at the time of the start of the image forming operation, the controller 6 (a) turns on the transfer bias supply 5, (b) starts the rotational driving of the driving roller 31 (roller motor 10) to start the rotational movement of the transfer belt 4 and (c) starts the driving of each drum motor 7 to start the rotation of the photosensitive drums 2M, 2C, 2Y and 2BK, sequentially in this order, at determined minute intervals.

As a result, a speed difference between the photosensitive drums 2M, 2C, 2Y and 2BK and the transfer belt 4 is prevented at the time of the start of the image forming operation, thereby preventing the photosensitive drums 2M, 2C, 2Y and 2BK from being scratched due to the rubbing against a foreign matter.

Figure 2:
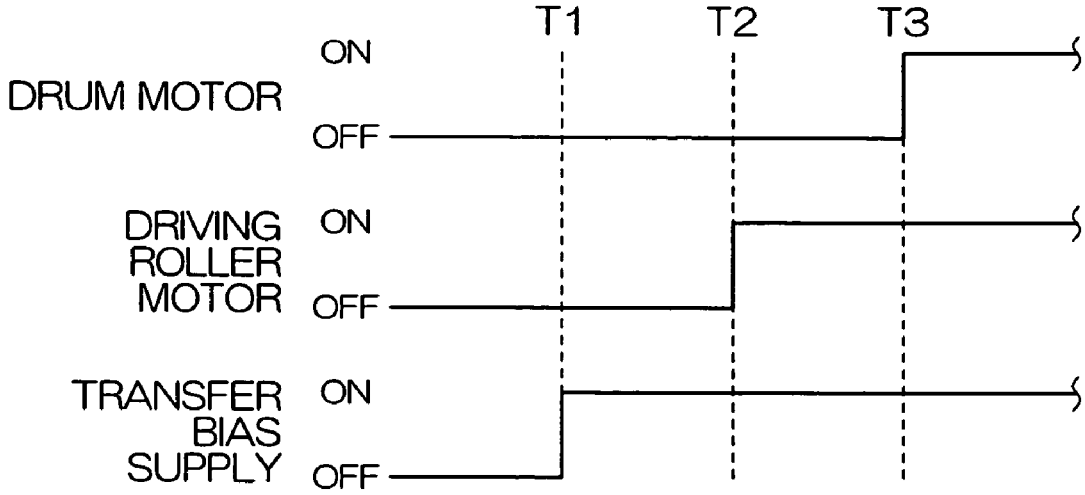
FIG. 2 is a timing chart for explaining operations of a transfer bias supply, a driving roller motor and each drum motor.

FIG. 2 is a timing chart for explaining the operations of the transfer bias supply 5, the roller motor 10 and each drum motor 7 at the time of the start of the image forming operation. With reference to FIGS. 1 and 2, at the time of the start of the image forming operation, the controller 6 firstly turns on the transfer bias supply 5 (timing T1). Thus, transfer bias is applied to the transfer rollers 32.

Due to the electrical charge of the transfer rollers 32 to which transfer bias is applied, the transfer belt 4 is attracted to the photosensitive drums 2M, 2C, 2Y and 2BK at the contact sections N. This allows the transfer belt 4 to cooperate with the movement of the photosensitive drums 2M, 2C, 2Y and 2BK so as not to rub against each other.

After the expiration of a predetermined minute time (for example, 100 ms) from the turn-on of the transfer bias supply 5, the controller 6 starts the driving of the roller motor 10 (timing T2). Thus, the driving of the driving roller 31 is started. The transfer belt 4 starts to be driven and the photosensitive drums 2M, 2C, 2Y and 2BK also starts rotating since the drums are attracted to the transfer belt 4 by the electrical charge.

Here, while the image forming operation is not performed (in the stop state), the transfer belt 4 has a slack between the contact section N of the photosensitive drum 2BK and driving roller 31 (in FIG. 1, a slack section of the transfer belt 4 is shown by a chain double-dashed line).

For this reason, a predetermined time (time lag) is needed from when the driving roller 31 starts driving until the transfer belt 4 is sufficiently tensioned by the driving roller 31 to be stably driven.

However, since the transfer belt 4 is attracted to the photosensitive drum 2BK, when the driving roller 31 places a tension on a short section of the transfer belt 4 between the photosensitive drum 2BK and the driving roller 31, the transfer belt 4 can be sufficiently tensioned. Thus, the time lag can be shortened by rapidly placing a sufficient tension on the transfer belt 4.

After the expiration of a predetermined minute time (for example, 100 ms) since the roller motor 10 started driving, the controller 6 starts the driving of each drum motor 7 (timing T3). Thus, the photosensitive drums 2M, 2C, 2Y and 2BK start rotating. At this time, since the transfer belt 4 having a slow rising time is attracted to the photosensitive drums 2M, 2C, 2Y and 2BK due to the electrical charge, the transfer belt 4 is led by the photosensitive drums 2M, 2C, 2Y and 2BK having a quick rising time to increase the rotating speed.

The moment when the drum motors 7 starts driving, the photosensitive drums 2M, 2C, 2Y and 2BK start rotating and are stably driven. For this reason, by starting the driving of the drum motors 7 after the expiration of the minute time from the start of the driving of the roller motor 10 in consideration of the time lag to the stable driving of the transfer belt 4, the speed of the transfer belt 4 and the speed of the photoconductor drums 2M, 2C, 2Y and 2BK can be synchronized during the whole period including the rising period.

Another feature of this embodiment is that, at the time of the termination of the image forming operation, the controller 6 turns off (stops) the transfer bias supply 5 after both the rotational movement of the transfer belt 4 and the rotation of the photosensitive drums 2M, 2C, 2Y and 2BK are stopped.

Specifically, after the sheet P passes the contact section N of the photosensitive drum 2BK and is discharged to the outside of the device, the controller 6 stops the driving of the drum motors 7 and the roller motor 10 respectively. Thus, the photosensitive drums 2M, 2C, 2Y and 2BK, and the driving roller 31 (transfer belt 4) rotate only for a predetermined time due to inertia and then stop.

At this time, since the photosensitive drums 2M, 2C, 2Y and 2BK and the transfer belt 4 are attracted to each other at the corresponding contact sections N due to transfer bias, it is prevented that the photosensitive drums 2M, 2C, 2Y and 2BK and the transfer belt 4 from moving together and rubbing against each other.

After the expiration of a predetermined minute time (for example, 100 ms) since both the photosensitive drums 2M, 2C, 2Y and 2BK and the transfer belt 4 stopped, the controller 6 turns off the transfer bias supply 5.

As described above, according to this embodiment, by turning on the transfer bias supply 5 prior to both the operation of the photosensitive drums 2M, 2C, 2Y and 2BK and the transfer belt 4 at the time of the start of the image forming operation, the electrification charge for transfer is applied to each of the contact sections N so that the photosensitive drums 2M, 2C, 2Y and 2BK and the transfer belt 4 are attracted to each other.

Accordingly, at the time of the start of the image forming operation when the photosensitive drums 2M, 2C, 2Y and 2BK and the transfer belt 4 easily rub against each other, both components move together, thereby preventing the rubbing. As a result, even when a foreign matter such as sand enters the contact sections N, it can be prevented that the photosensitive drums 2M, 2C, 2Y and 2BK from rubbing against the foreign matter and being scratched, thereby preventing the deterioration in image quality caused by generating an unnecessary toner image.

In the state where the photosensitive drums 2M, 2C, 2Y and 2BK and the transfer belt 4 are attracted to each other at the corresponding contact sections N, the driving roller 31 is rotated prior to the photosensitive drums 2M, 2C, 2Y and 2BK.

Thus, the time from when a sufficient tension is placed on the transfer belt 4 by the driving roller 31 until the transfer belt 4 is stably driven can be shortened. As a result, the time (first output time) from the start of the image forming operation until an image is formed on a first sheet P can be shortened, thereby further decreasing the rising time of the image forming operation.

Furthermore, in consideration of the time (time lag) from the start of the rotation of the driving roller 31 to the stable driving of the transfer belt 4, the rotation of the photosensitive drums 2M, 2C, 2Y and 2BK is started after the expiration of a minute time from the start of the rotation of the driving roller 31. Thus, the speed of the transfer belt 4 and the speed of the photoconductor drums 2M, 2C, 2Y and 2BK can be synchronized during the whole period including the rising period, so that it can be prevented more securely that the photosensitive drums 2M, 2C, 2Y and 2BK and the foreign matter from rubbing against each other.

Still furthermore, at the time of the termination of the image forming operation, the photosensitive drums 2M, 2C, 2Y and 2BK and the transfer belt 4 are attracted to each other by the application of transfer bias until both the transfer belt 4 and the photosensitive drums 2M, 2C, 2Y and 2BK are completely stopped. Thus, at the time of the termination of the image forming operation when the photosensitive drums 2M, 2C, 2Y and 2BK and the transfer belt 4 easily rub against each other, both components move together, thereby preventing the rubbing.

As a result, it can be prevented that the photosensitive drums 2M, 2C, 2Y and 2BK from rubbing against the foreign matter at the contact sections N and being scratched, thereby preventing the deterioration in image quality caused by generating an unnecessary toner image.

As described above, even when the surface of each photosensitive drum 2M, 2C, 2Y and 2BK is formed using hard amorphous silicon, since the photosensitive drums 2M, 2C, 2Y and 2BK can be prevented from rubbing against the foreign mater at the corresponding contact sections N, the photosensitive drums can be satisfactorily prevented from being scratched.

The present invention is not limited to the contents of the above embodiment and various modifications can be made.

For example, at the time of the termination of the image forming operation, the photosensitive drums 2M, 2C, 2Y and 2BK are completely stopped, then the rotation of the driving roller 31 may be completely stopped after the expiration of a predetermined minute time (for example, 300 ms) and then the transfer bias supply 5 may be turned off.

In this case, in the state where the transfer belt 4 is attracted to the photosensitive drum 2BK at the contact section N, the driving roller 31 applies a tension on the transfer belt 4 for the above-mentioned minute time. Thus, even after the image forming operation, the transfer belt 4 become tensioned between the photosensitive drum 2BK and the driving roller 31. Accordingly, at the start of the next image forming operation, the time for applying a tension to the transfer belt 4 can be eliminated, thereby further shortening the first output time.

Furthermore, by providing a minute time difference between the timing at which the driving roller 31 stops driving and the timing at which the photosensitive drums 2M, 2C, 2Y and 2BK stops driving, the photosensitive drums 2M, 2C, 2Y and 2BK and the transfer belt 4 may be stopped simultaneously.

Still furthermore, the transfer bias may be applied or not except when the image forming operation is started and terminated, and when the toner image is transferred on the sheet P.

The transfer belt may be used as an intermediate transfer belt. In this case, the toner image formed in each of the photosensitive drums is transferred on the transfer belt and then, transferred on the sheet.

Further, the present invention can apply to monochrome copying machines having one photosensitive drum as well as other image forming devices other than the copying machines.

This Application corresponds to Japanese Patent Application No. 2005-54416 filed with the Japanese Patent Office on Feb. 28, 2005, the disclosure of which is incorporated herein by reference.

What is claimed is:

1. An image forming apparatus comprising: a drum-shaped image carrier; a transfer belt which is extended between at least two rollers so as to rotationally move, has a stretch section in contact with the image carrier; and a transfer bias applying means which applies an electrical charge for transfer on a contact section between the transfer belt and the image carrier, wherein at the start of an image forming operation, operations of the transfer bias applying means, the rollers and the image carrier are started at predetermined minute intervals in the following order, (a) the transfer bias applying means is operated, (b) the rollers are rotated, and (c) the rotation of the image carrier is started.

2. An image forming apparatus as stated in claim 1, further comprising a stop control means which stops the operation of the transfer bias applying means after the rotational movement of the transfer belt and the rotation of the image carrier is stopped.

3. An image forming apparatus as stated in claim 1, wherein the image carrier is formed using amorphous silicon.

* * * * *